United States Patent [19]

Wood et al.

[11] 4,088,289

[45] May 9, 1978

[54] MAST SUPPORT ARRANGEMENT FOR PORTABLE DRILL RIG

[75] Inventors: John L. Wood, Salem; Thomas C. Wenrich, Roanoke, both of Va.

[73] Assignee: Gardner-Denver Company, Dallas, Tex.

[21] Appl. No.: 772,048

[22] Filed: Feb. 25, 1977

[51] Int. Cl.[2] ..... E21C 11/02

[52] U.S. Cl. ..... 248/2; 52/116; 173/28

[58] Field of Search ..... 248/2, 13, 16; 173/28; 52/115, 116, 117

[56] References Cited

U.S. PATENT DOCUMENTS

| | | | |
|---|---|---|---|
| 2,842,340 | 7/1958 | Burress | 173/28 UX |
| 3,205,627 | 9/1965 | Gyongyosi | 52/116 X |
| 3,322,378 | 5/1967 | Thompson | 248/16 X |
| 3,417,524 | 12/1968 | Norlin et al. | 52/117 X |
| 3,529,679 | 9/1970 | Leven | 173/28 |
| 3,809,344 | 5/1974 | Kolderup | 248/16 |
| 3,919,816 | 11/1975 | Ranft | 52/116 |
| 3,965,628 | 6/1976 | Loftis | 52/116 X |
| 3,992,831 | 11/1976 | Bukovitz | 52/116 |

*Primary Examiner*—J. Franklin Foss
*Attorney, Agent, or Firm*—Michael E. Martin

[57] ABSTRACT

A portable rock drill rig includes a pair of telescoping struts for supporting and positioning a mast or feed beam. The struts are connected at their upper ends to a support bracket which is connected to an elongated mast support member by a hydraulic cylinder to provide relative sliding movement between the bracket and support member. The drill rig includes a crawler undercarriage having spaced apart and pivotally mounted crawler assemblies. The lower ends of the struts are each connected to an arm which is fixed to the main frame of the undercarriage. The arms are also connected to respective track oscillation cylinders. The mounting arrangement of the struts provides for improved positioning of the mast for drilling, tramming and transport operations.

5 Claims, 6 Drawing Figures

MAST SUPPORT ARRANGEMENT FOR PORTABLE DRILL RIG

BACKGROUND OF THE INVENTION

One type of portable rock drill rig is generally characterized by a crawler undercarriage upon which is mounted an elongated mast or feed beam for slidably supporting a drill motor. The mast is adapted through its support arrangement to be pivoted about one or more pivot axes whereby drilling in various directions may be carried out and the mast may be positioned for ease of transport from one work site to another.

The ever increasing need for drilling deeper holes in one pass of the drill along the mast has resulted in mast lengths which are so great as to make it difficult to provide mounting and positioning mechanisms which will provide a suitable range of mast positions for drilling and permit lowering of the mast to a suitable position for transporting the rig in a stable condition requiring minimum vertical clearance.

U.S. Pat. Nos. 3,322,378 and 3,529,679 disclose mast mounting arrangements for drilling apparatus of the general type to which the present invention pertains.

SUMMARY OF THE INVENTION

The present invention provides an improved mounting arrangement for the mast or feed beam of a portable drilling apparatus whereby the range of drilling positions is increased and whereby the mast may be placed in a transport position which is relatively stable and provides for reduced vertical height of the rig.

The present invention further provides an mounting arrangement for the mast of a portable rock drill rig which is characterized by an elongated support member which is mounted at one end on a universal pivot member and which is supported adjacent the opposite end by a pair of telescoping support struts which are connected to a sliding bracket disposed on the support member. The mast is mounted on the support member and is adapted for limited linear sliding movement with respect to the support member.

The present invention also provides an improved arrangement for supporting the telescoping struts at their lower ends whereby the forces exerted on the struts are transmitted at least partly to the track oscillation cylinders and also to the main frame of the undercarriage.

DESCRIPTION OF THE PREFERRED EMBODIMENT

Figure 1:
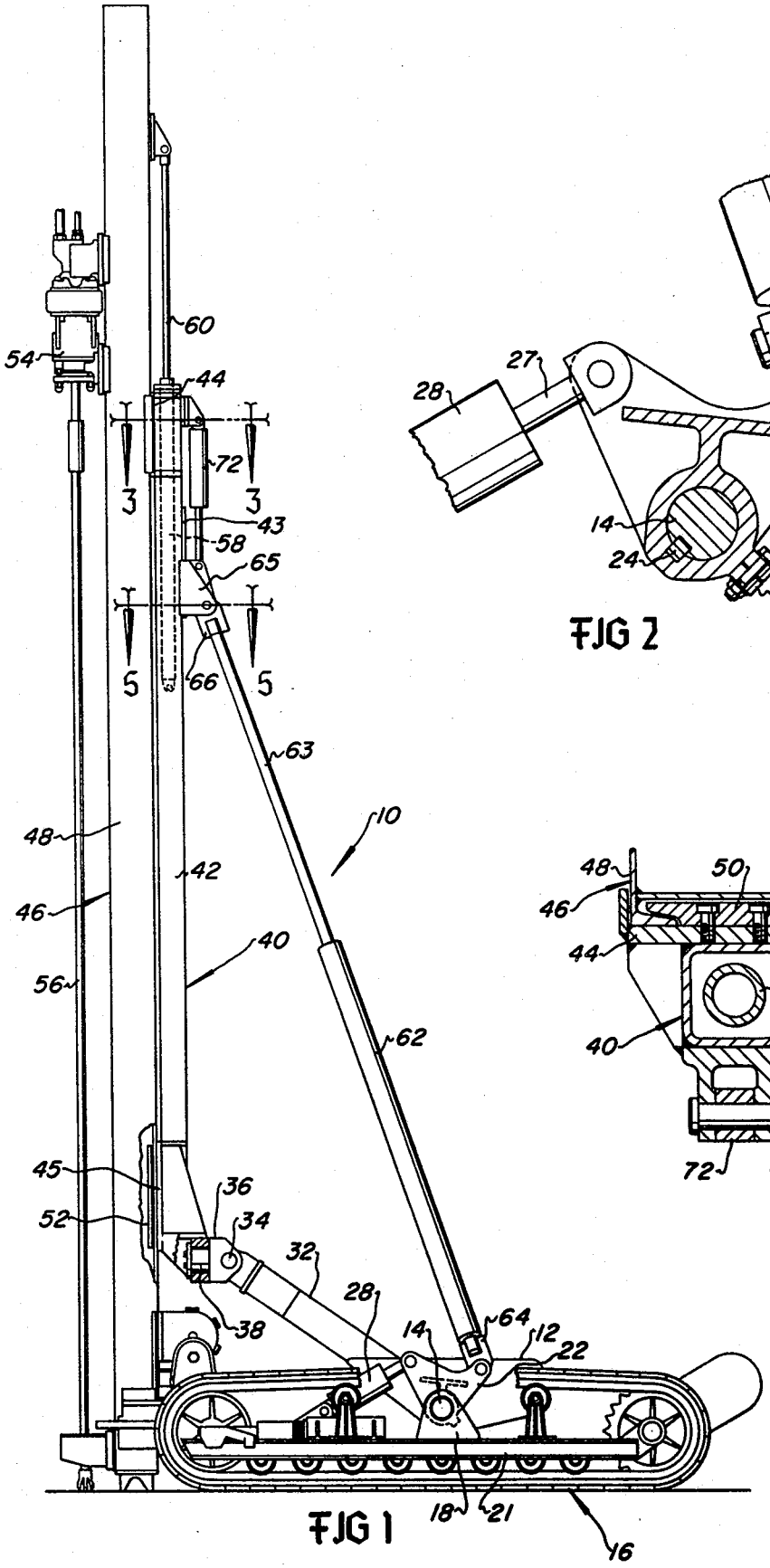
FIG. 1 is a longitudinal side elevation of a portable drill rig including the improved mast mounting arrangement of the present invention.
Figure 2:
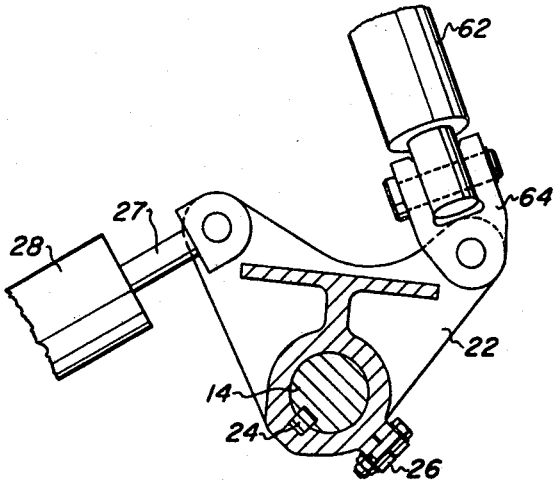
FIG. 2 is a section view taken along the line 2—2 of FIG. 4.
Figure 4:
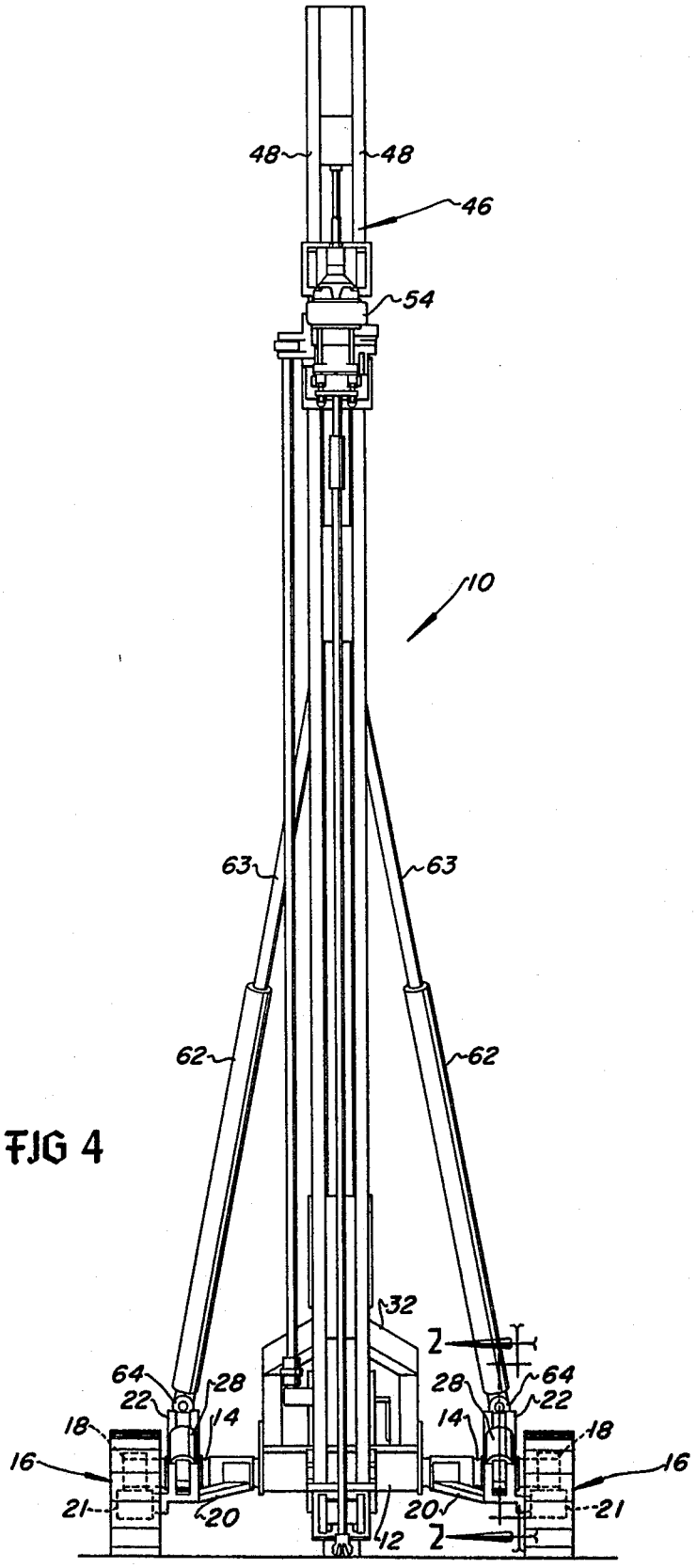
FIG. 4 is a transverse front elevation of the drill rig shown in FIG. 1.

Referring to FIGS. 1 and 4 the present invention is embodied in a portable rock drill rig, generally designated by the numeral 10. The drill rig 10 is characterized by a frame 12 which includes a transverse axle 14 projecting laterally from opposite sides of the frame. The axle 14 is pivotally connected to a pair of spaced apart crawler track assemblies 16 by means of bearing supports 18 and 20 forming part of a track frame 21 of each of the crawler assemblies. A pair of spaced apart support arms 22 are disposed on the axle 14 and are each removably fixed nonrotatable with respect to the axle by a suitable means such as a key 24 and an integrally formed split ring clamp 26, as shown in FIG. 2. One portion of each of the arms 22 is connected to the distal end of a piston rod 27 of a hydraulic cylinder actuator 28 as shown in FIGS. 1, 2, and 4. The opposite end of each cylinder 28 is connected to a respective bearing support member 20 attached to the track frame 21 of the crawler assembly. The general arrangement of the cylinder actuators 28 including a pressure fluid circuit for operating the cylinders is similar to the arrangement disclosed in U.S. Pat. No. 2,842,340.

The drill rig 10 also includes a boom 32 which projects forwardly from the frame 12 and includes a transverse pivot pin 34 disposed on its distal end. The pin 34 pivotally supports a clevis 36. The clevis 36 includes a trunnion 38 which pivotally supports one end of an elongated mast support member 40. The mast support member 40 is thus connected to the boom 32 for pivotal movement with respect to the boom about two mutually perpendicular axes formed by the pin 34 and trunnion 38.

Figure 3:
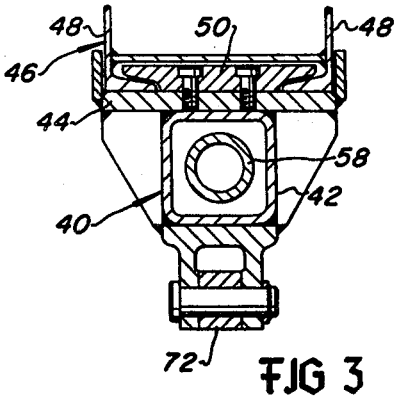
FIG. 3 is a section view taken along the line 3—3 of FIG. 1.

Referring to FIGS. 1 and 3 the support member 40 comprises an elongated hollow tube 42 of rectangular cross section to which are fixed spaced apart flanges 44 and 45. The drill rig 10 further includes an elongated mast 46 characterized by a pair of interconnected elongated channel members 48. The mast 46 is disposed on the support member 40 for linear sliding movement therealong and is retained on the support member by spaced apart retainer plates 50 and 52 which are suitably fastened to the flanges 44 and 45. A drill motor 54 is slidably disposed on the mast 46 and is operable to be moved linearly back and forth along the mast in a conventional manner by suitable feed mechanism, not shown. The drill motor 54 is operable to transmit rotary motion and percussive blows to a drill stem 56 attached thereto. The mast 46 is adapted for limited linear movement with respect to the support member 40 by a hydraulic cylinder actuator 58. The cylinder 58 is disposed within and connected to the tube 42. The distal end of the piston rod 60 of the cylinder 58 is suitably connected to the mast 46 as shown in FIG. 1.

Figure 5:
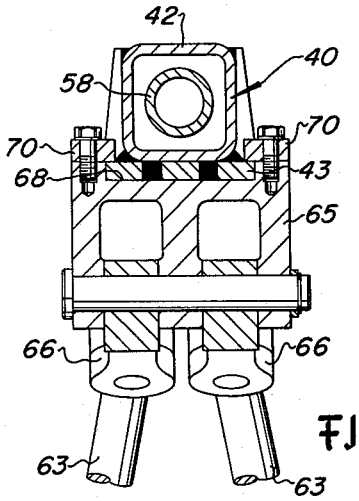
FIG. 5 is a section view taken along the line 5—5 of FIG. 1.

The drill rig 10 further includes a pair of telescoping struts comprising elongated hydraulic cylinders 62. The cylinders 62 are connected to respective ones of the arms 22 by clevis members 64 to provide for universal pivotal movement of the cylinders about two mutually perpendicular axes. Such coupling arrangements are sometimes referred to as universal joints. Referring to FIGS. 1 and 5, the opposite ends of the cylinders 62, comprising the distal ends of piston rods 63, are pivotally connected to a sliding bracket 65 by way of clevis members 66 similar to the clevis members 64. The clevis members 66 interconnect the piston rods 63 with the bracket 65 to provide for universal pivotal movement of the cylinders 62 with respect to the bracket about two mutually perpendicular axes.

The support member 40 includes a second flange 43 fixed to the side of the tube 42 opposite the flange 44.

The bracket 65 includes a channel 68 and retainer plates 70 whereby the bracket may be slidably retained on the support member 40 as shown in FIG. 5. The bracket 65 is also interconnected with the mast support member 40 by a hydraulic cylinder actuator 72 to provide for positioning the bracket at various positions along the support member.

Figure 6:
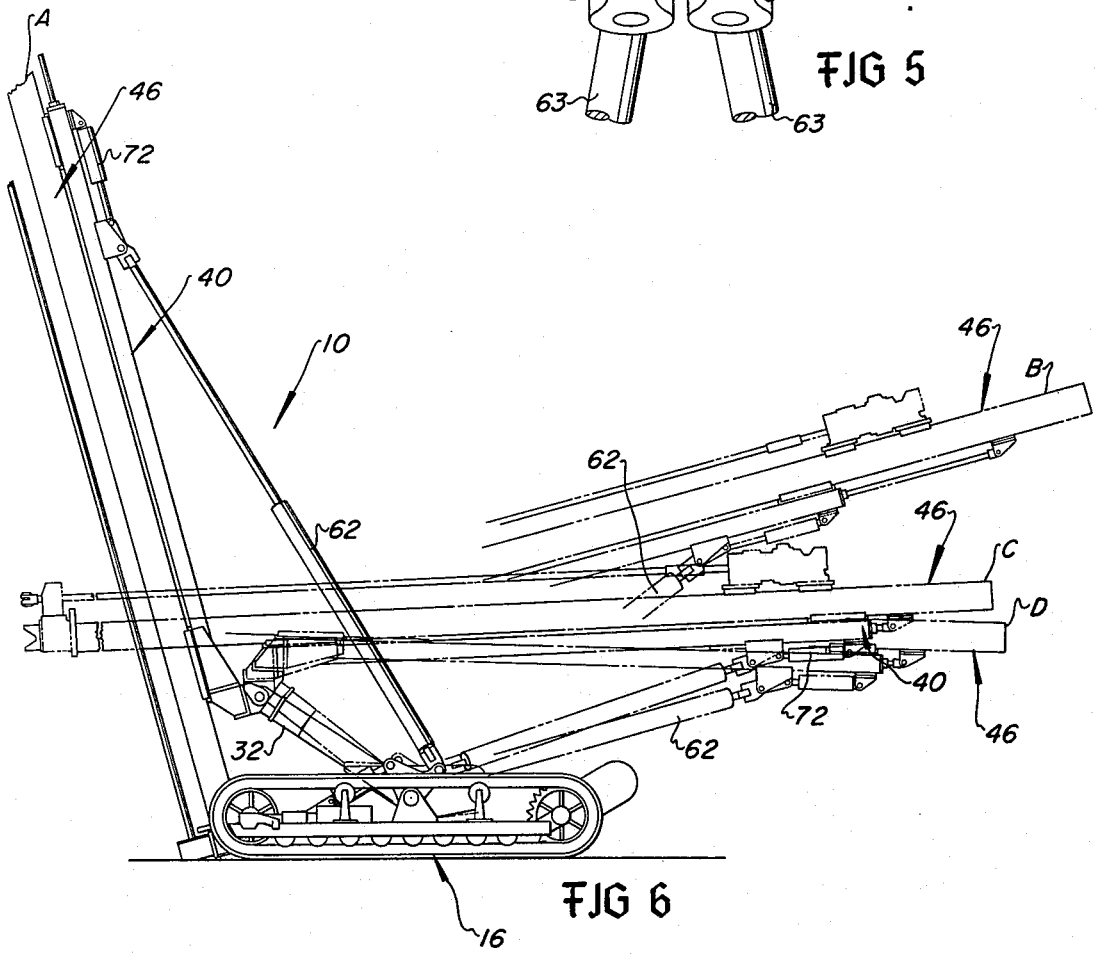
FIG. 6 is a side elevation view showing various positions of the mast.

Referring to FIG. 6, the range of mast positions which may be obtained by actuation of the cylinders 62, with the cylinder actuator 72 fully extended, is illustrated by the limit positions A and B. Thanks to the longitudinally slidable mounting of the bracket 65 on the support member 40 the position of the upper cylinder pivot connections, comprising the clevises 66, may be changed to lower the mast to position C upon retraction of the cylinder actuator 72. If further lowering of the mast is desired for transport of the rig or for extending the range of drilling positions both track oscillation cylinders 28 may be simultaneously extended to pivot the frame 12 with respect to the crawler assemblies 16 thereby moving the mast to position D. In positions C and D the cylinder actuator 58 is shown retracted also. Accordingly, the combination of the mast positioning cylinders 62 and 72 together with the track oscillation cylinders 28 provides a drill rig which is more versatile in its operating range and which is more easily transported. Moreover, the provision of the sliding bracket 65 permits the main mast positioning cylinders 62 to be mounted at their lower ends farther from the lower pivot connection of the support member 40 with respect to the boom 32 than prior art drilling rigs thereby improving the stability of the mast in many drilling positions.

Suitable pressure fluid controls for operating the cylinder actuators 28, 58, 62, and 72 may be located at an appropriate operator's control station on the drill rig 10.

An important improvement realized with the mast support arrangement of the present invention is provided by the arms 22 for supporting the cylinders 62 and the cylinders 28 whereby at least a portion of the forces exerted on the arms 22 and the axle 14 by the cylinders 62 may be transmitted through the cylinders 28 to the track frames 21 to reduce the stresses on the axle.

What is claimed is:

1. A portable drill rig comprising:

a frame;

a mast support universally pivotally connected to said frame adjacent one end of said mast support;

a drill mast disposed on said mast support;

a pair of telescoping struts for positioning and supporting said mast with respect to said frame, said struts including means at one end of each of said struts for universally pivotally interconnecting said struts and said frame and wherein said one ends are transversely spaced apart from each other;

a member connected to said mast support for limited longitudinal movement with respect to said mast support;

means on the end of each of said struts opposite said one end for universally pivotally connecting said struts to said member; and, an actuator for moving said member with respect to said mast support whereby the range of positioning of said mast with respect to said frame may be increased.

2. The invention set forth in claim 1 wherein:

said member is disposed on said mast support for sliding movement therealong, and said actuator comprises a hydraulic cylinder for positioning said member with respect to said mast support.

3. A portable drill rig comprising:

a frame including transverse axle means;

a pair of spaced apart crawler assemblies pivotally supporting said frame therebetween on said axle means;

a mast support universally pivotally connected to said frame adjacent one end of said mast support;

a drill mast disposed on said mast support for limited longitudinal movement with respect to said mast support;

a pair of telescoping struts for positioning and supporting said mast with respect to said frame, said struts including means at one end of each of said struts for universally pivotally interconnecting said struts and said frame and wherein said one ends are transversely spaced apart from each other;

a member disposed on said mast support for limited longitudinal sliding movement with respect to said mast support;

means on the end of each of said struts opposite said one end for universally pivotally connecting said struts to said member; and, a hydraulic cylinder actuator for moving said member with respect to said mast support whereby the range of positioning of said mast with respect to said frame may be increased.

4. The invention set forth in claim 3 wherein:

said drill rig includes a pair of hydraulic cylinders interconnecting said frame with said crawler assemblies, respectively, for pivotally moving said frame with respect to said crawler assemblies for further increasing the range of positions of said mast.

5. A portable drill rig comprising:

a frame including transverse axle means;

a pair of spaced apart crawler assemblies pivotally supporting said frame therebetween on said axle means;

a mast support universally pivotally connected to said frame adjacent one end of said mast support;

a drill mast disposed on said mast support for limited longitudinal movement with respect to said mast support;

a pair of telescoping struts for positioning and supporting said mast with respect to said frame, said struts including means at one end of each of said struts for universally pivotally interconnecting said struts and said frame and wherein said one ends are transversely spaced apart from each other;

a member connected to said mast support for limited longitudinal movement with respect to said mast support;

means on the end of each of said struts opposite said one end for universally pivotally connecting said struts to said member;

an actuator for moving said member with respect to said mast support whereby the range of positioning of said mast with respect to said frame may be increased;

a pair of hydraulic cylinders interconnecting said frame with said crawler assemblies, respectively, for pivotally moving said frame with respect to said crawler assemblies for further increasing the range of positions of said mast; and, a pair of spaced apart suppport arms removably fixed to said axle means, each of said support arms being connected to one of said hydraulic cylinders and said one end of one of said telescoping struts whereby at least part of the forces on said telescoping struts may be transmitted to said hydraulic cylinders.

* * * * *